US007324651B2

(12) United States Patent
Roeck

(10) Patent No.: US 7,324,651 B2
(45) Date of Patent: Jan. 29, 2008

(54) FEEDBACK SUPPRESSION

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 859 days.

(21) Appl. No.: 10/800,582

(22) Filed: Mar. 15, 2004

(65) Prior Publication Data

US 2005/0201579 A1 Sep. 15, 2005

(51) Int. Cl.
*H04R 25/00* (2006.01)

(52) U.S. Cl. ..... 381/318; 381/93; 381/312

(58) Field of Classification Search ..... 381/83, 381/93, 94.1, 94.2, 312, 317, 318, 320, 321
See application file for complete search history.

(56) References Cited

U.S. PATENT DOCUMENTS 5,091,952 A * 2/1992 Williamson et al. ..... 381/318
6,498,858 B2 * 12/2002 Kates ..... 381/318

FOREIGN PATENT DOCUMENTS

| | | |
|---|---|---|
| EP | 0 656 737 A | 6/1995 |
| EP | 1 080 606 A | 3/2001 |
| WO | 00/19605 A | 4/2000 |
| WO | 00/33634 A | 6/2000 |

OTHER PUBLICATIONS

Herbordt W. et al. "Computationally Efficient Frequency-Domain Combination of Acoustic Echo Canclation and Robust Adaptive Beamforming:" Proceedings Eurospeech, vol. 2, Sep. 2001 pp. 1001-1004, XP 007004503 Aalborg, Danmark.

Hsiang-Feng Chi, Shawn X. Gao, Sigfrid D. Soli, Abeer Alwan: "Band Limited Feedback Cancellation with a Modified Filtered-x LMS Algorithm for Hearing Aids" Speech Communication, vol. 39, No. 1-2, Jan. 2003, pp. 147-161, XP002295470 Elsevier Science.

Maxwell J.A. et al: "Reducing Acoustic Feedback in Hearing Aids" IEEE Transactions on Speech and Audio Processing, IEEE Inc. New York, US, vol. 3, No. 4, Jul. 1, 1995, pp. 304-313, XP 000633074 ISN: 1063-6676.

Hoshuyama O. et al: "A Robust Adaptive Beamformer for Microphone Arrays with A Blocking Matrix Using Constrained Adaptive Filters" IEEE Transactions on Signal Processing, IEEE, Inc. New York, US, vol. 47, No. 10, Oct. 1999, pp. 2677-2684, XP 000947154, ISSN: 1053-587X.

* cited by examiner

*Primary Examiner*—Huyen Le
(74) *Attorney, Agent, or Firm*—Pearne & Gordon LLP

(57) ABSTRACT

Acoustical signals impinging on an input converter are converted into a first electric signal by a controllably variable transfer characteristic. The transfer characteristic is dependent on the angle at which the acoustical signals impinge on the input converter. The first electric signal is processed and a resulting signal is applied to an output converter. Feedback to be suppressed is compensated by a feedback compensating signal, which is generated in dependency of the resulting signal and is fed back by a feedback signal path upstream of the processing. The electric feedback compensating signal is fed back to and superimposed upon the first electric signal. An adaptation rate of the converting into a first electric signal by a controllably variable transfer characteristic is controlled in dependency of the loop gain along the feedback signal path.

14 Claims, 3 Drawing Sheets

FEEDBACK SUPPRESSION

The present invention deals with a method for suppressing feedback between an acoustical output of an electrical/acoustical output converter arrangement and an acoustical input of a acoustical/electrical input converter arrangement of a hearing device, wherein acoustical signals impinging on the input converter arrangement are converted into a first electrical signal, by a controllably variable transfer characteristic and which is dependent on the angle at which said acoustical signals impinge on the input converter arrangement. The first electrical signal is processed and a resulting signal is applied to the output converter. There is further provided an electrical feedback-compensating signal, generated in dependency of the result signal which is applied via a feedback signal path upstream the processing.

Definition

A unit to which the output of the input converter arrangement is input and which provides a signal transfer characteristic to its output which has an amplification dependent on spatial angle at which acoustical signals impinge on the acoustic input of the input converter arrangement is called a beamformer unit. The transfer characteristic in polar representation is called the beam.

An adaptive beamformer unit is a beamformer unit, the beam generated therefrom being controllably variable.

From the EP 0 656 737 there is known such a method which nevertheless does not apply beamforming. The input of a feedback-compensator is operationally connected to the input of the output converter arrangement of the device, the output of the compensator is operationally connected to the output of the input converter arrangement, thereby forming a feedback signal path.

Due to the complex task of estimating the feedback-signal to be suppressed e.g. by correlation at the feedback-compensator, the feedback-compensation process has a relatively long adaptation time constant to adapt from one feedback situation to be suppressed to another by appropriately varying its gain. Such an adaptation time constant is customarily in the range of hundreds of milliseconds.

Figure 1:
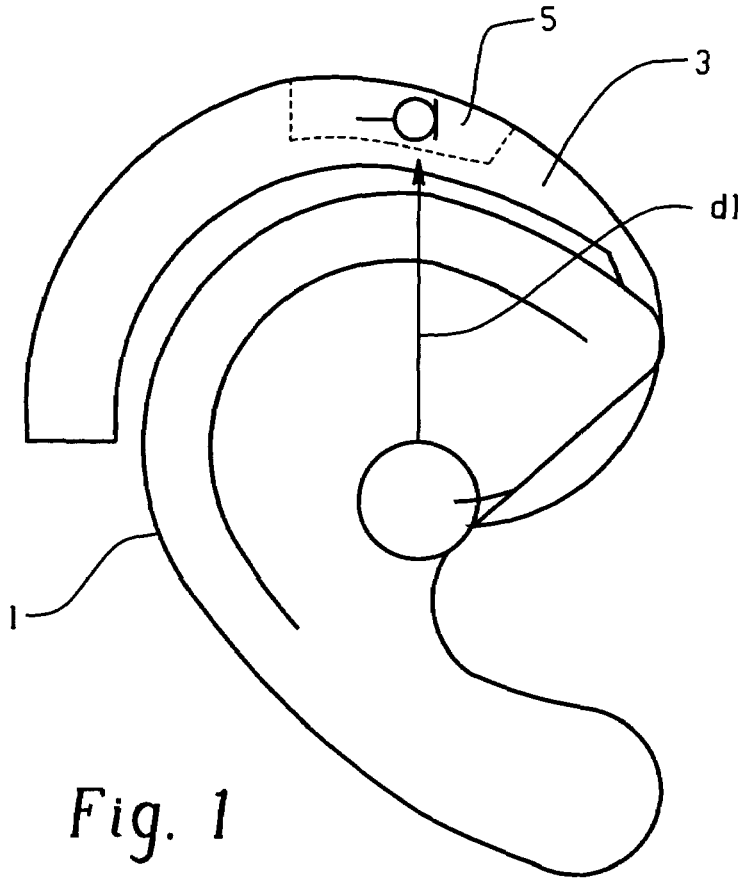

Feedback signals to be suppressed impinge upon the input acoustical/electrical converter arrangement substantially from distinct spatial angles. As schematically shown in FIG. 1, a behind-the-ear hearing device 3 with an input converter arrangement 5 applied at the pinna 1 of an individual, experiences feedback to be suppressed from a distinct direction as shown at d1. An in-the-ear hearing device 7 according to FIG. 2 which has, as an example, a vent 9 and two acoustical ports 11 to the input converter arrangement, experiences feedback signals to be suppressed from the distinct directions d2.

Therefore, a further approach for suppressing feedback is to install high signal attenuation between the input and the output converter of the device for signals which impinge on the input converter under such distinct spatial angles. This accords with applying a beamformer technique generating a beam having zero or minimum amplification at such angles.

Hearing devices which have adaptive beamformer ability are known e.g. from the WO 00/33634. For feedback suppression at a hearing device with adaptive beamforming ability, it seems, at first, quite straight forward to combine on the one hand feedback compensation techniques as e.g. known from the EP 0 656 737 with adaptive beamformer technique as e.g. known from the WO 00/33634 and thereby to place minimum amplification of the beam at those angles which are specific for feedback signals to be suppressed impinging on the input converter. This especially because these angles are clearly different from the target direction range within which maximum amplification of the beam is to be variably set.

Thereby, it has to be noted that the adaptation time constant of an adaptive beamformer unit is considerably smaller, in the range of single to few dozen milliseconds, than the adaption time constant of a feedback-compensator which is, as mentioned above, in the range of hundreds of milliseconds.

One approach is known where a beamformer unit is provided, the input thereof being operationally connected to two mutually distant microphones of an input converter arrangement. As both spaced apart microphones experience the feedback signal to be suppressed differently, two feedback compensators are provided with inputs operationally connected to the input of the output converter arrangement. The respective output signals are superimposed to the respective output signals of the two microphones.

The fact that the adaptation time constant of the beamformer unit is much shorter than the adaptation time constant of the compensators does not pose a problem in this configuration, because the fast adapting beamformer unit is placed within the closed feedback loop formed by the feedback-compensation feedback paths.

Nevertheless, this known approach has the serious drawback that for each of the microphones one compensator feedback path must be provided which unacceptably raises computational load.

A further approach for beamformer/feedback-compensation combination is known from M. Brandenstein et al. "Microphone arrays", Springer Verlag 2001. Here the feedback compensation path is fed back to the output of the beamformer unit. By this approach only one compensation path is necessary and thus computational load is reduced. Nevertheless, here the fast adapting beamformer is outside the negative feedback loop. Thus, whenever the adaptive beamformer is controlled to rapidly change its beam pattern, the compensator will not be able to adequately rapidly deal with the new situation of feedback to be suppressed.

Therefore, M. Brandenstein et al. "Microphone arrays" considers this approach as, at least, very difficult to realise.

A third approach is proposed in M. Brandenstein et al. as mentioned and in W. Herbold et al. "Computationally efficient frequency domain combination of acoustic echo cancellation and robust adaptive beamforming". A generalised side lobe cancelling technique for the beamformer is used whereat only a not-adaptive beamformer is placed upstream the compensation feedback path, thus eliminating the adaptation time problem as well as double computational load. Nevertheless, by this approach placing minimum amplification of the beam in the direction of feedback signal arrival may not be realised.

It is an object of the present invention to provide a method for suppressing feedback as addressed above at a hearing device which has an adaptive beamformer on the one hand, and a feedback compensator on the other hand, thereby avoiding the drawbacks as addressed above.

This is achieved on the one hand by superimposing the fed back feedback compensating signal to the signal downstream the beamforming, and, on the other hand, by controlling the adaptation rate of beamforming in dependency of the gain along feedback signal path with the compensator.

Thus, there is proposed a method for suppressing feedback between an acoustical output of an electrical/acoustical output converter arrangement and an acoustical input of an acoustical/electrical input converter arrangement of a hearing device, wherein acoustical signals impinging on the input converter arrangement are converted into a first electric signal by a controllably variable transfer characteristic which is dependent on the angle at which said acoustical signals impinge on said input converter arrangement. The first electric signal is processed and a resulting signal is applied PTO the output converter arrangement. The feedback to be suppressed is compensated by a feedback compensating signal which is generated in dependency of the resulting signal and is fed back by a feedback signal path to a location along the signal path upstream the processing. Thereby, the feedback-compensating signal is fed back to the first electric signal—thus downstream the beamformer—and the adaptation rate of converting to variations of the transfer characteristic—and thus of beamforming—is controlled in dependency of gain along the compensator feedback signal path.

Definition

We understand by the adaptation rate of the adaptive beamformer unit the speed with which the beamformer unit reacts on an adaptation command to change beamforming operation as e.g. changing target enhancement or noise suppression direction. The adaptation rate accords with an adaptation time constant to change from one beamforming polar pattern to another.

We understand by the adaptation rate of feedback-compensating the rate with which the respective compensator reacts on a detected change of feedback situation until the compensator has settled to a new setting. The compensator thereby estimates the prevailing situation of feedback to be suppressed e.g. by a correlation technique between the signal applied to the output converter arrangement and the signal received from the input converter arrangement as e.g. described in the EP 0 656 737. The adaptation rate of the compensator accords with an adaptation lime constant too. Whenever the loop gain along the compensating feedback signal path increases, this is caused by an increasing amount of feedback to be suppressed and thus to be compensated. This means that the adaptation rate of the beamformer unit is to be slowed down so that the compensator feedback signal may model the response of the beamformer unit too. Thus, in a preferred embodiment, the adaptation rate of converting i.e. of beamforming is slowed down with increasing loop gain along the feedback signal path.

As was addressed above, feedback signals, which are acoustical and which have to be suppressed, impinge on the acoustical input of the input converter arrangement substantially and dependent on the specific device at specific angles. Thus, in a most preferred embodiment of the method according to the present invention, amplification of the transfer characteristic representing beamforming is minimized at one or more than one specific angles which accord to angles at which the feedback to be suppressed predominantly impinges on the input converter arrangement.

Thus, and considered in combination with slowing down the adaptation rate of beamforming with increasing gain along feedback compensation fed back signal path, it becomes apparent that the compensator may still model the beamformer without losing the established minimum or minima in the direction of the said specific angles.

Further, it has to be noted that the feedback to be suppressed is a narrow band acoustical signal, thus in a further improvement of the method according to the present invention, it is not necessary—so as to deal with a feedback to be suppressed—to control and especially to slow down the adaptation rate of beamforming conversion in the entire frequency range beamforming is effective at, but it suffices to controllably adapt the adaptation rate of the beamforming conversion at frequencies which are significant for the feedback signal to be suppressed. Therefore, in a further preferred embodiment of the present invention, controlling of the adaptation rate of the beamforming conversion is performed frequency selectively.

In spite of the fact that the principal according to the present invention may be applied at hearing devices where signal processing is performed in analog technique, it is preferred to perform the method in devices where signal processing is performed digitally. Thereby, and in view of the addressed preferred frequency selective control, in a most preferred embodiment, at least signal processing in the beamforming conversion as well as along the feedback compensation path, is performed in frequency domain, whereby time domain to frequency domain conversion may be realised in a known manner, be it by FFT, DCT, wavelet transform or other suitable transforms. The respective reconversion for the signal applied to the output converter arrangement is performed with the respective inverse processes. The adaptation rate is controlled at selected frequencies in dependency of the compensator gain at these selected frequencies. Thereby the following approach is achieved:

As beamforming is only effective with respect to the feedback to be suppressed at specific frequencies or at a specific frequency band on the one hand the control of the adaptation rate of beamforming is in fact only to be performed at these specific frequencies or for the addressed frequency band. Further, selecting minimum amplification at the specific feedback impingement angles must be provided at the beamformer only for the specific frequencies or for the frequency band of the feedback to be suppressed too. Thus, this leads to the recognition that in fact beamforming may be subdivided in beamforming for frequencies which are not significant for the feedback to be suppressed and beamforming for frequencies or the frequency band which is specific for the feedback signal to be suppressed. Thus, beamforming in the addressed specific frequencies may be performed and its adaptation rate controlled independently from tailoring beamforming at frequencies which are not specific for the feedback signal to be suppressed. This beamforming may be performed at adaption rates which are independent from feedback compensation and thus faster and which generates a beam which is not dealing with the specific impinging angles of the feedback signal to be suppressed.

Therefore, in a further preferred embodiment of the method according to the present invention, performing controlling of beamforming is done selectively at frequencies which are significant for the feedback to be suppressed. Further preferred minimalising the amplification of the beamforming transfer characteristic is only done at specific angles in a frequency selection manner. In fact two independent beamforming actions are superimposed, a first dealing with the generically desired beamforming behaviour, a second dealing with feedback suppression as concerns frequencies and as concerns beamshaping. It becomes possible e.g. to switch off first beamforming, thereby maintaining the second and thereby preventing acoustical feedback to become effective. The method according to the present invention may be applied to behind-the-ear hearing devices or to in-the-ear hearing devices, monaural or binaural systems, and further may be applied to such devices which are conceived as ear protection devices i.e. protecting the human ear from excess acoustical load, or to hearing improvement devices be it just to improve or facilitate hearing by an individual, or in the sense of a hearing aid, to improve hearing of a hearing impaired individual.

It is to be noted that feedback caused not by acoustical but by electrical or mechanical reasons is often fed into the microphones of the input converter arrangement with equal gains and phases, thus appearing to originate from a direction perpendicular to the port axis of the input converter arrangement. In an endfire array, as typically used in hearing instruments, this conforms to a 90° direction or arrival, and may be suppressed by a beamformer arrangement according to the present invention as well.

To resolve the object as mentioned above, there is further, and according to the present invention, provided a hearing device which comprises:

an acoustical/electrical input converter arrangement and a adaptive beamformer unit generating at an output an electric output signal dependent on acoustical signals impinging on said input converter arrangement and in dependency of angle at which said acoustical signals impinge, said beamformer unit having a first control input for varying beamforming characteristics and a second control input for controllably adjusting adaptation rate;

a processing unit with an input operationally connected to the output of said beamformer unit with an output operationally connected to an input of an electrical/acoustical output converter arrangement;

a feedback compensator unit, the input thereof being operationally connected to said input of said electrical/acoustical output converter arrangement, the output thereof being operationally connected to the input of said processing unit and having a loop gain output, said loop gain output being operationally connected to said second control input of said beamformer unit.

Figure 2:
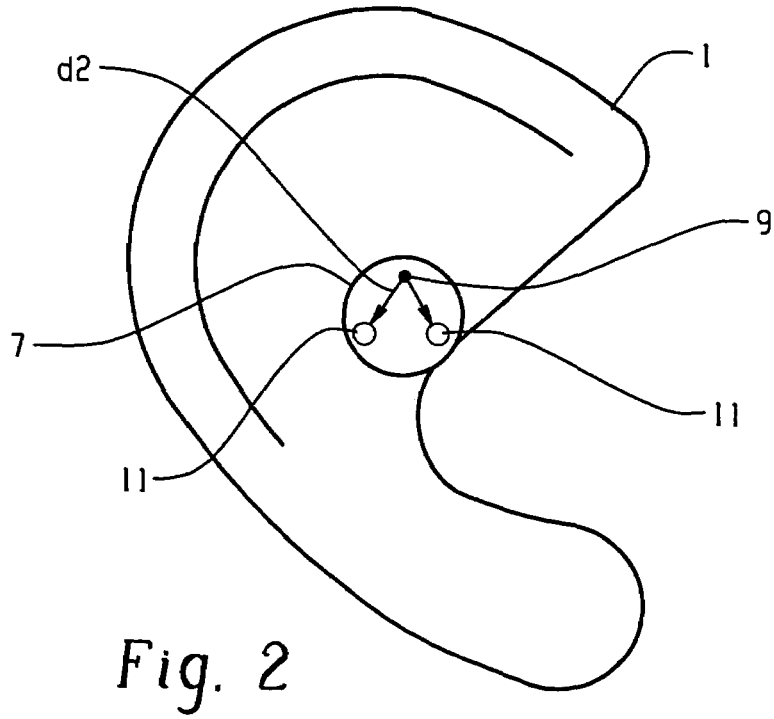

Preferred embodiments of the method according to the present invention, as well as of a hearing device according to the present invention, shall additionally become apparent from the following detailed description of preferred embodiments with the help of further figures and from the claims. The figures show:

FIGS. 1 & 2: as discussed above, schematically specific angles at which feedback signals impinge on the acoustical input port of outside-the-ear (FIG. 1) and in-the-ear (FIG. 2) hearing devices.

Figure 3:
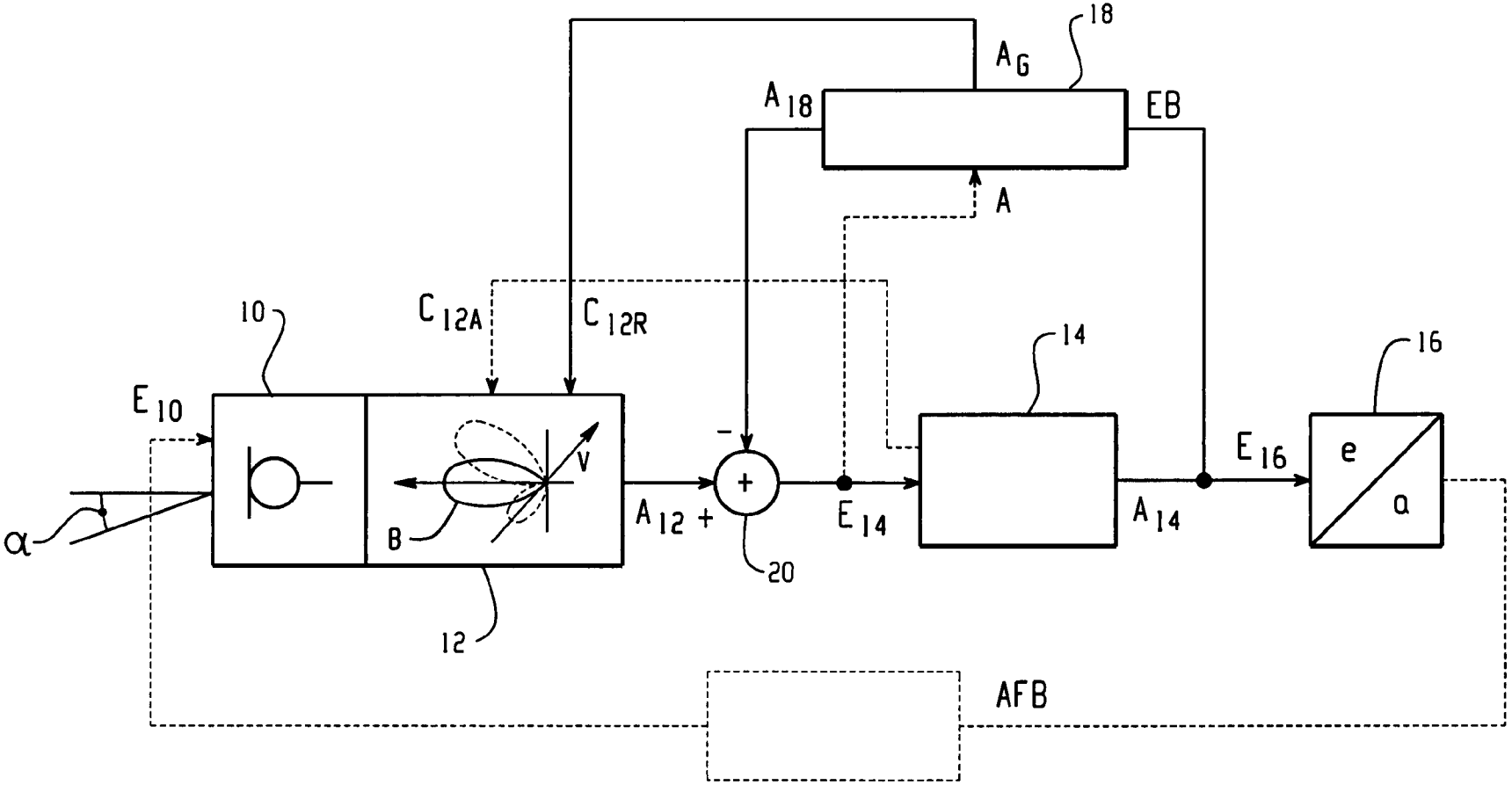

FIG. 3: by means of a simplified functional block/signal flow-diagram, a device according to the present invention operated according to the method of the present invention.

Figure 4:
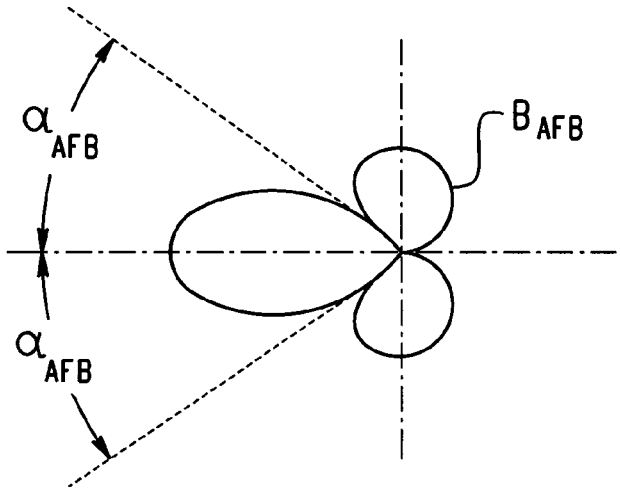

FIG. 4: in polar diagram representation preferred beamforming at the device according to FIG. 3 taking into account specific angles with which the feedback to be suppressed impinges on the acoustic input as exemplified in the FIG. 1 or 2.

Figure 5A:
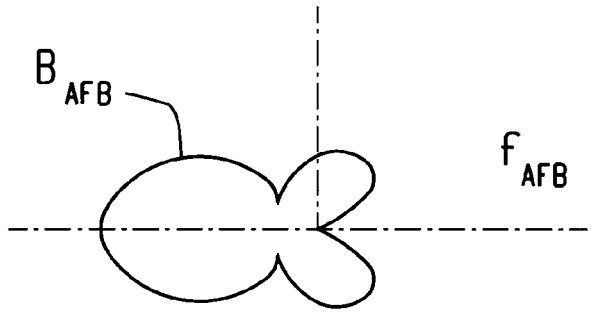

FIG. 5*a*: as an example and quantitatively, beamforming by the device of FIG. 3 at specific frequencies which are significantly present in the feedback signal to be suppressed.

Figure 5B:
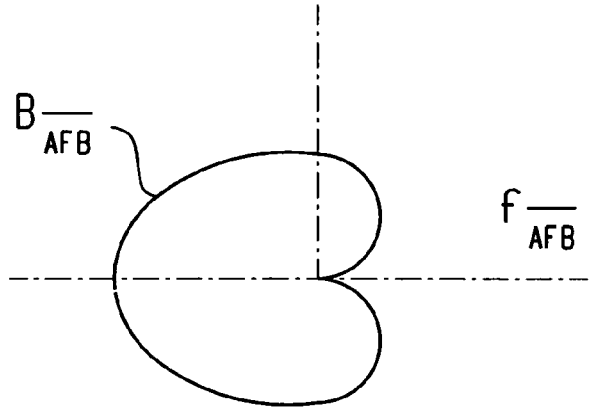

FIG. 5*b*: beamforming at the device of FIG. 3 for frequencies which are not significantly present in the feedback signal to be suppressed.

In FIG. 3 there is schematically shown, by means of a signal flow-/functional block-diagram a device according to the present invention, whereat the method according to the invention is realised. The device comprises an input acoustical/electrical converter arrangement 10, which cooperate with a beamformer unit 12. The conversion characteristics of the input converter arrangement 10 together with signal processing in beamformer unit 12 provides a beamformer characteristic between acoustical input $E_{10}$ to input converter arrangement 10 and electrical output $A_{12}$ of the beamformer unit 12. The beamformer unit 12 has an adaptation control input $C_{12A}$ and $\alpha$ adaptation rate control input $C_{12R}$.

The transfer characteristic between $E_{10}$ and $A_{12}$ has an amplification which is dependent on the angle $\alpha$ at which acoustical signals impinge on the acoustical port of input converter 10. Thus, there is generated by the combined units 10 and 12 a beam characteristic as exemplified with B in unit 12.

As further schematically shown by the variation arrow V within block 12, the transfer characteristic, in polar representation the beam B, may be varied with respect to its characteristics as e.g. with respect to target direction, maximum amplification etc. as shown in dotted line within block 12. Variation of the beam characteristic B is controlled by control input $C_{12A}$ which latter is, as shown in dotted line, normally connected to a processing unit 14 for adapting the beam characteristic B e.g. to prevailing acoustical situations automatically or program controlled or by an individual wearing the hearing device.

Beamforming units which may be adapted are known. One example thereof is described in the WO 00/33634.

Variation of the beam characteristic B may also be caused al the beamformer itself, i.e. by beamformer internal reasons.

Therefore, it must be emphasised that the input $C_{12A}$ and control signals applied thereto are merely a schematic representation of beam characteristic variation ability or occurrence.

The electrical output of beamforming unit 12, $A_{12}$, is operationally connected to an input $E_{14}$, of the signal processing 14 unit whereat input signals are processed and output at an output $A_{14}$ operationally connected to an electric input $E_{16}$ of an output electrical to acoustical converter arrangement 16 so as to provide desired ear protections or hearing improvement to the individual carrying such device. We understand under ear protecting ability the ability of reducing or even cancelling acoustical signals which impinge on the input converter arrangement 10, so as to protect individual's hearing or even provide the individual with silent perception in non-vanishing acoustical surroundings. Under hearing improvement, we understand the improvement of individual's hearing in an acoustical surrounding, be it for customary applications of normal hearing individual or be it in the sense of hearing aid to improve individual's impaired hearing.

As perfectly known to the skilled artisan, one ongoing problem in context with such hearing devices is the acoustical feedback AFB between the acoustical output of the output converter 16 and acoustical input $E_{10}$ of the input converter arrangement 10. As principally known e.g. from the EP 0 656 737, there is provided a feedback compensator 18 whereat the prevailed acoustical feedback AFB, which is to be suppressed, is estimated e.g. with a correlation technique, correlating the signal applied to output converter 16 with a signal dependent on the output of input converter 10 as shown in dashed line at A. Thereby the gain G of compensator 18 is estimated so a to compensate for the AFB by negative feedback.

By means of compensator unit 18, a signal as predicted is fed back to the input of processor unit 14 downstream the output of beamformer unit 12 so as to compensate for the feedback AFB. As shown in FIG. 3, the compensator unit 18 has an input E18 which is operationally connected to the output $A_{14}$ of the processing unit 14 and has an output $A_{18}$ which is superimposed to the output $E_{12}$ of beamformer unit 12, the result of such superimposing being input to input $E_{14}$ of processing unit 14.

Customarily, the compensator unit 18, which computes estimation of the acoustical feedback to be suppressed, has an adaptation rate in the range of several hundred ms and is thus considerably slower than the adaptation rate of beamforer unit 12. Thus without additional measures according to the present invention, whenever the beamformer unit 12 is controlled or caused to vary its beamforming characteristic B as schematically represented by a control at input $C_{12A}$, the compensator 18 will not be able to accurately rapidly deal with the varied situation with respect to acoustical feedback AFB.

Therefore, there is provided a control of the adaptation rate of beamformer unit 12 which control is performed by the compensator unit 18, according to FIG. 3 at control input $C_{12R}$. Whenever the feedback signal loop gain via compensator 18 rises, indicating the increase in acoustical feedback AFB to be suppressed, the adaptation rate or time constant of beamformer unit 12 is lowered to or below the adaptation rate of compensator unit 18.

The loop gain may at be least estimated e.g. by multiplying the linear gains along the loop, primarily consisting of the compensator 18 and the processing unit 14 in FIG. 3 or by adding these gains in dB.

Thereby, it is prevented that an adjustment of the beamformer unit 12 with respect to its beamforming characteristic B may not be dealt with by compensator unit 18.

Thus, in fact, adaptation rate control of beamformer unit 12 is performed in dependency of the loop gain along the feedback loop with compensator unit 18. The rate control input $C_{12R}$ to beamforming unit 12 is operationally connected to a loop gain output $A_G$ of unit 18. With the embodiment according to the present invention as shown in FIG. 3, it becomes possible to slow down the adaptation rate of the beamformer unit 12 at least down to the adaptation rate of the feedback compensator unit 18 in dependency of prevailing feedback of compensator 18.

Thereby, combination of adaptive beamforming and feedback compensating becomes feasible.

As has already been mentioned, the direction with which acoustical feedback signals AFB to be suppressed impinge on the acoustical port of the input converter 10 is specific. Therefore, at the beamformer unit 12, there is generated a beam characteristic $B_{AFB}$, as shown in FIG. 4, which has minimum amplification for these specific angle or, as shown e.g. for an in-the-ear hearing device, at two specific angles $\alpha_{AFB}$ Thus and in addition to compensation of AFB by compensator unit 18, beamforming is realised with minimum amplification for those spatial angles $\alpha_{AFB}$ with which the acoustical feedback AFB to be suppressed impinges on the input converter 10.

Further, it has to be noticed that acoustical feedback AFB to be suppressed occurs substantially within a specific frequency band. This frequency band is dependent, among others, on the specific output converter 16 used, the type of device e.g. in-the-ear or outside-the-ear device. Therefore, in a further improved embodiment, overall feedback suppression may be performed within that specific frequency band, thereby leaving beamforming in frequencies not within this specific frequency band unaffected and tailored according to needs different from acoustic feedback suppression. According to FIG. 5 (*a*), beamforming $B_{\overline{AFB}}$ for minimum amplification of acoustical feedback AFB to be suppressed, is performed frequency selectively for frequencies $f_{\overline{AFB}}$ of the acoustical feedback signal AFB. Beamforming for frequencies $f_{AFB}$ which are not significantly present in the acoustical feedback AFB is performed by a second beamforming $B_{\overline{AFB}}$ which may be selected independently from $B_{AFB}$.

In fact, two independent beam forms are superimposed each operating in respective, distinct frequency-bands. Frequency selective feedback compensation and adaptation beamforming may easily be realised, if at least beamforming in unit 12 as well as compensation in unit 18 are performed in frequency domain respectively in sub-bands. Beamforming is then realised at the frequencies $f_{AFB}$ with minimum amplification at the specific angles $\alpha_{AFB}$, whereas beamforming at other frequencies $f_{\overline{AFB}}$ is performed according to other needs. Consequently the adaptation rate of beamforming in unit 12 is only controlled by the gain of compensator unit 18 at the frequencies $f_{AFB}$.

Thus, even when beamforming $B_{\overline{AFB}}$ is switched off to minimum overall amplification, beamforming $B_{AFB}$ may be maintained active to suppress feedback also in such "quiet" mode. Thereby, and with an eye on processing in frequency domain, in each sub-band, which is significant for AFB, the loop gain, as estimated in compensator unit 18, may be compared with a threshold value and adaptation rate control at $C_{12R}$ is only established, if the instantaneous loop gain at least reaches such threshold. The control of the adaptation rate may then be lowered to practically zero, which means that beamforming is switched off for frequencies $f_{AFB}$. This establishes a hard on/off-switching of beamforming in the $f_{AFB}$ frequency-range. In a further approach, such switching may be performed steadily which may be realised on the one hand by lowering the adaptation rate of $B_{AFB}$ steadily and/or by reducing beamforming amplification of $B_{AFB}$ steadily.

Due to the inventively improved suppression of acoustical feedback from the output of the output converter to the input of the input converter, there is reached additional stability of the device. The inter dependencies of vent tailoring at in-the-ear hearing devices and acoustical feedback problems is resolved to a significantly higher degree than was possible up to now when the device had the ability of adaptive beamforming.

The invention claimed is:

1. A method for suppressing feedback between an acoustical output of an electrical/acoustical output converter arrangement and an acoustical input of an acoustical/electrical input converter arrangement of a hearing device comprising the steps of converting acoustical signals impinging on the input converter arrangement into a first electric signal by a controllably variable transfer characteristic, which is dependent on an angle at which said acoustical signals impinge on said input converter arrangement;

processing said first electric signal and applying a resulting signal to the output converter arrangement; and compensating said feedback to be suppressed by a feedback compensating signal, which is generated in dependency of the resulting signal and is fed back by a feedback signal path upstream said processing;

wherein further said electric feedback compensating signal is fed back to and superimposed upon the first electric signal and adaptation rate of said converting to variations of said transfer characteristic is controlled in dependency of loop gain along said feedback signal path.

2. The method of claim 1, further comprising slowing down the adaptation rate of said converting with increasing loop gain along said feedback signal path.

3. The method of claims 1 or 2, further comprising minimizing amplification of said transfer characteristic at one or more specific angles which accord to angles at which said feedback to be suppressed predominately impinges on said input converter arrangement.

4. The method of claim 1, further comprising frequency selectively controlling said adaptation rate.

5. The method of claim 1, further comprising performing said converting in said first electric signal, and said processing along said feedback signal path in frequency domain and controlling said adaptation rate at selected frequencies in dependency of said loop gain at said selected frequencies.

6. The method of claim 1, further comprising minimizing amplification of said transfer characteristic at specific angles frequency selectively.

7. The method of claim 1, further comprising performing said converting into said electric signal independently for frequencies present in said feedback to be suppressed and for frequencies substantially not present in said feedback to be suppressed.

8. The method of claim 1, further comprising performing said control of said adaptation rate selectively for frequencies present in said feedback to be suppressed, said control comprising switching said converting on and off for said frequencies present.

9. The method of claim 8, further comprising performing switching from on to off and/or vice versa steadily during a predetermined timespan.

10. The method of claim 1, said hearing device being a behind-the-ear or an in-the-ear hearing device.

11. The method of claim 1, said hearing device being an ear protection or a hearing improvement device.

12. A hearing device, comprising:

an acoustical/electrical input converter arrangement and an adaptive beamformer unit, said beamformer unit generating at an output an electric output signal dependent on acoustical signals impinging on said input converter arrangement and in dependency of an angle at which said acoustical signals impinge, said beamformer unit having a first control input for varying beamforming characteristics;

a processing unit with an input operationally connected to the output of said beamformer unit and with an output operationally connected to an input of an electrical/acoustical output converter arrangement; and a feedback compensator unit, an input thereof being operationally connected to said input of said electrical/acoustical output converter arrangement, an output thereof being operationally connected to the input of said processing unit;

wherein further said beamformer unit has a second control input for adjusting adaptation rate, said output of said feedback compensator unit is operationally superimposed with the output of said beamformer unit, said feedback compensator unit has an output for a loop gain indicative signal, being operationally connected to said second control input of said beamformer unit.

13. The device of claim 12 being a behind-the-ear hearing device or an in-the-ear hearing device.

14. The device of one of claims 12 or 13, being a hearing protection device or a hearing improvement device.

* * * * *